US007868272B2

(12) United States Patent
Yokota et al.

(10) Patent No.: US 7,868,272 B2
(45) Date of Patent: Jan. 11, 2011

(54) INDUCTION HEATING DEVICE AND IMAGE FORMING APPARATUS EQUIPPED WITH SUCH INDUCTION HEATING DEVICE

(75) Inventors: Shogo Yokota, Osaka (JP); Tomohiro Maeda, Osaka (JP); Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/179,825

(22) Filed: Jul. 13, 2005

(65) Prior Publication Data

US 2006/0049175 A1 Mar. 9, 2006

(30) Foreign Application Priority Data

Jul. 15, 2004 (JP) ..... 2004-208928
Sep. 6, 2004 (JP) ..... 2004-258684

(51) Int. Cl.
*H05B 6/14* (2006.01)

(52) U.S. Cl. ..... 219/619; 399/328; 399/333

(58) Field of Classification Search ..... 219/619, 219/469; 399/328–338; 428/692.1
See application file for complete search history.

(56) References Cited

U.S. PATENT DOCUMENTS 6,882,807 B2 4/2005 Sakagami ..... 399/69
6,898,409 B2 * 5/2005 Tsueda et al. ..... 399/328
2004/0173603 A1 * 9/2004 Kinouchi et al. ..... 219/661
2004/0253887 A1 * 12/2004 Katakabe et al. ..... 442/6

FOREIGN PATENT DOCUMENTS

| | | | |
|---|---|---|---|
| JP | 11-297463 | | 10/1999 |
| JP | 11-352804 | | 12/1999 |
| JP | 2001-235951 | | 8/2001 |
| JP | 2001-312168 | A | 11/2001 |
| JP | 2001-343860 | | 12/2001 |
| JP | 2002-49261 | | 2/2002 |
| JP | 2002-158083 | A | 5/2002 |
| JP | 2002-289336 | A | 10/2002 |
| JP | 2003-228249 | | 8/2003 |
| WO | 03/043379 | A1 | 5/2003 |

* cited by examiner

*Primary Examiner*—Quang T Van
(74) *Attorney, Agent, or Firm*—Nixon & Vanderhye, P.C.

(57) ABSTRACT

In an external heating type induction heating device in which a magnetic field producing means is arranged in the outer circumferential portion of a heating roller 1, two heat generating layers, namely a conductive shaft 1*a* and a surface heat generating layer 1*c*, are provided in the heating roller 1, and the surface heat generating layer 1*c* is formed having a thickness through which passes a portion of an alternating magnetic field, and the conductive shaft 1*a* at a center of the heating roller 1 is heated by a portion of the alternating magnetic field produced by the magnetic field producing means passing through the surface heat generating layer 1*c* to link to the conductive shaft 1*a* present at the center of the roller, thereby preventing a drop in a surface temperature of the heating roller 1.

9 Claims, 10 Drawing Sheets

INDUCTION HEATING DEVICE AND IMAGE FORMING APPARATUS EQUIPPED WITH SUCH INDUCTION HEATING DEVICE

BACKGROUND

This application claims priority under 35 U.S.C. §119(a) on Patent Application No. 2004-208928 and Patent Application No. 2004-258684 filed in Japan respectively on Jul. 15, 2004 and Sep. 6, 2004, the entire contents of which are hereby incorporated by reference.

The present invention relates to induction heating devices and image forming apparatuses equipped with such induction heating devices that can be suitably used with such devices as fixing devices in dry process electrophotographic devices, drying devices in wet process electrophotographic devices, drying devices in inkjet printers, and erasing devices for rewritable media.

In heating devices, for example the fixing devices in dry process electrophotographic devices, the drying devices in wet process electrophotographic devices, and the heating devices used in erasing devices for rewritable media, a structure that has been long and widely used is one in which a halogen lamp is provided inside a heating roller made of aluminum or the like having a hollow core, and in which the heating roller is subjected to radiation heating by the halogen lamp. Since systems using these halogen lamps are indirect heating systems, there are the problems that the startup time at the commencement of heating is slow and the warm up time is long.

Accordingly, attention is being given to induction heatng devices in which a conductive layer is provided on the heating roller, and an eddy current is produced in the conductive layer by applying alternating magnetic fields produced by a magnetic field producing means, such that a heat generating layer is directly heated by the Joule heat of the eddy current. These induction heating devices directly heat the structure to be heated, and therefore have superior heating efficiency, but in order to achieve shorter warm up times and to further improve practical convenience, it is necessary to achieve low thermal capacity in the heating roller.

One technique for achieving low thermal capacity in the medium to be heated in induction heating devices is to make the heating roller into a belt form, but in this case new problems are presented such as a mechanism being required to prevent meandering of the belt. A technique for achieving low thermal capacity in a roller-form structure to be heated has been proposed as a method for solving this (see JP 2002-49261A for example [hereinafter referred to as patent document 1]).

While setting the thickness of the heat generating layer thinner than the thickness of the surface layer achieves lower thermal capacity, there is insufficient mechanical strength, and therefore the method described in patent document 1 achieves mechanical strength as well by using a structure in which the heat generating layer is backed up by a low thermal conduction layer and a high thermal conductive cylindrical rigid body.

Furthermore, in order to further reduce the heating time in conventional belt systems using halogen lamps as the heat source, a heating device has been proposed that also incorporates an induction heating means that heats the belt portion (see JP 2003-228249A for example [hereinafter referred to as patent document 2]).

Further still, although for a different purpose, a method in which heat sources are provided inside and outside the heating roller has been proposed (see JP 2001-343860A for example [hereinafter referred to as patent document 3]). The art described in patent document 3 has a different purpose than the art of the two above-mentioned patent documents 1 and 2. For example, depending on the image to be copied, there are areas in which no image information is present, and heating these areas results in consuming energy for no purpose. For this reason, the art of patent document 3 involves adjusting the electrical power of the outside heat source according to the image pattern, and an induction heating system is proposed as one of those outside heating means.

In this regard, with the above-mentioned patent document 1, the time taken to raise the temperature of the heat generating layer is reduced and the warm up time is reduced by setting the heat generating layer thinner than the surface layer to lower the thermal capacity and by arranging a low thermal conductive member between the heat generating layer and the cylindrical rigid body to prevent heat loss from the heat generating layer.

However, since the low thermal conduction layer has a strong thermal blocking effect, the temperature of the low thermal conduction layer becomes lower than the heat generating layer at the point when the surface of the heating roller reaches the predetermined temperature, that is, at the point in time immediately after warming up. In other words, since only the heat generating layer portion that has been made to have low thermal capacity is made to store heat at a high temperature, when continuous copying is carried out under this condition, heat other than the heat conveyed to the unfixed image escapes from the heat generating layer to the low thermal conduction member, and therefore the surface temperature of the roller cannot be maintained and there is the issue of fixing nonconformities occurring due to temperature drops.

Furthermore, since induction heating systems are localized heating systems in which generated heat is greater concentratedly in the heat generating layer that is closer to the heating coil, large temperature unevenness is produced in the circumferential direction of the heating roller when heating is carried out while the heating roller is in a stationary state. For example, FIG. 11 is a drawing for describing the transition in roller surface temperature when preheating is carried out in a stationary condition and the roller is made to return to normal after this condition. As is evident from FIG. 11, there are temperature peaks in the areas being preheated by the heating coil, and therefore it is understood that there are high temperature places and low temperature places in the circumferential direction of the roller. This temperature unevenness in the circumferential direction is particularly large in the case of external heating systems with temperature unevenness of 30° C. or more being produced.

The only method for solving this is a method in which temperature adjustment is carried out over a long time while rotating the heating roller to achieve uniformity, and thus there is an issue in that it is difficult to reduce the time for the first copy. That is, circumferential direction unevenness is solved when preheating while rotating, but there is a separate issue in that the amount of heat released increases, and therefore the amount of electrical power consumed during preheating increases and energy efficiency cannot be achieved.

With the art described in patent document 2, the heating of the belt is carried out using thermal contact conductance from a heating roller (in which a halogen lamp is arranged inside) installed in a position apart from the fixing nip portion and by induction heating by a heating coil installed between the heating roller and the fixing roller, and therefore there are many opportunities for heating the belt and it is possible to raise the temperature of the belt in a short time. However, since there is no heat source at the fixing roller portion that forms the fixing nip portion for fixing the toner, there is an issue in that when the temperature of the fixing roller is low, the temperature of the fixing belt drops during continuous copying, thus causing fixing nonconformities. Furthermore, temperature unevenness in the circumferential direction of the belt is produced since the positions of the fixing nip portion and the heating sources are different, and therefore there is an issue in that it is difficult to reduce the time of the first copy, which is the same for the above-mentioned patent document 1.

On the other hand, the art described in patent document 3 was devised giving consideration to the point that it is inefficient to uniformly heat areas in which toner (image) of the unfixed image is present and areas in which it is not present. A specific characteristic here is that only areas in which toner (image) is present are selectively heated by the external heating means. Furthermore, a main characteristic is that the surface temperature of the roller, which has dropped due to passing through the fixing nip, can be made to return to the predetermined temperature by regulating the electrical power of the external heating means when in conditions in which it is difficult to maintain the roller temperature such as in conditions of continuous copying. Consequently, the art of patent document 3 is not for controlling the thermal storage temperature conditions of the elastic support layer that supports the heat generating layer, and has issues the same as in the art of the above-mentioned two patent documents in that only the surface heat generating layer tends to a high temperature state and the surface temperature of the heating roller tends to drop easily.

SUMMARY

The present invention has been devised to solve these issues, and it is an object therein to provide an external heating type induction heating device in which a magnetic field producing means is arranged in the outer circumferential portion of a heating roller, wherein drops in the surface temperature of the heating roller that occur during continuous copying are prevented and that is capable of consistently carrying out continuous copying without pauses in processing or reductions in processing speed, as well as an image forming apparatus provided with an induction heating device having such characteristics.

An induction heating device of an example embodiment is provided with a heating roller having a conductive heat generating layer and a magnetic field producing means arranged on a external periphery of the heating roller, and configured such that the conductive heat generating layer is heated by applying alternating magnetic fields, produced by the magnetic field producing means, in the conductive heat generating layer of the heating roller, and heat of the heating roller is transferred to a medium to be heated at open portions where the magnetic field producing means is not arranged at the periphery of the heating roller, wherein the conductive heat generating layer of the heating roller has a conductive shaft that supports the heating roller, and a surface heat generating layer that is provided on a non-conductive heat resistant support member with thermal storage on the conductive shaft, and that is heated by the applied alternating magnetic fields produced by the magnetic field producing means, and the surface heat generating layer is formed having a thickness that enables a portion of the alternating magnetic fields to pass through.

With the induction heating device of an example embodiment, two heat generating layers, namely a conductive shaft and a surface heat generating layer, are provided in the heating roller, and therefore when the thickness of the surface heat generating layer is set not greater than the surface layer depth (60 μm in the case of nickel for example), a portion of the alternating magnetic field produced by the magnetic field producing means passes through the surface heat generating layer and links to the conductive shaft present in the center of the roller. In this way, the conductive shaft at the center of the heating roller is also heated such that the two heat generating layers can be heated at the same time. That is, the non-conductive heat resistant support member is heated by the transfer of heat from both the surface heat generating layer and the heat generating layer (conductive shaft) at the center of the roller so that the temperature can be raised for heating in a short time, thereby eliminating the temperature difference between the non-conductive heat resistant support member and the surface heat generating layer in a short time, and therefore heat does not escape from the surface heat generating layer to the non-conductive heat resistant support member during copying operations. Consequently, even during continuous copying, the surface temperature of the heating roller does not drop and continuous fixing can be achieved consistently without pauses in processing or reductions in processing speed. It should be noted that the surface heat generating layer may be a layered structure in which a plurality of conductive layers are layered.

With the induction heating device of an example embodiment, the surface heat generating layer of the heating roller may be formed by a composite material in which a conductive material has been dispersed in a flexible material. Thus, by making the surface heat generating layer a composite material in which a conductive filler has been dispersed in a heat resistant resin or rubber rather than a metal sleeve, the elasticity and flexibility in the surface portions of the heating roller that contacts the toner can be improved and auto-release can be achieved at the exit of the fixing nip without a releasing means, and therefore it is possible to consistently obtain images free of image deterioration.

The induction heating device of an example embodiment may be such that the heating roller has the non-conductive heat resistant support member, the surface heat generating layer, an elastic layer, and a surface release layer formed on the conductive shaft, and the non-conductive heat resistant support member and the elastic layer are constituted by material having a coefficient of linear expansion within a predetermined range (specifically, 20 to $40\times10^{-5}/°$ C.), and moreover the surface heat generating layer has, as a base material (elastic material), a material of the non-conductive heat resistant support member or the elastic layer that is within the above-described predetermined range of coefficient of linear expansion, and is formed as a composite material in which a conductive material has been dispersed within the base material. By constructing the surface heat generating layer using a base material having a coefficient of linear expansion substantially the same as the non-conductive heat resistant support member (or the elastic layer), it is possible to prevent wrinkling of the heating roller and the shape of the heating roller can be maintained even after repetitively performing heating and cooling.

In the induction heating device of an example embodiment, the following effect can be achieved when the non-conductive heat resistant support member, the surface heat generating layer, the elastic layer, and the surface release layer are formed in that order on the conductive shaft.

For example, when forming as separate members a component (elastic roller) in which a non-conductive heat resistant support member is formed on a conductive shaft (cored bar), and a component (cylindrical heat generating member) in which an elastic layer and a surface release layer are formed on the heat generating layer, then forming the heating roller by inserting the cylindrical heat generating member over the elastic roller in a later process, "raising" is produced in the roller during repetitive heating and cooling. In contrast to this, with an example embodiment, when the non-conductive heat resistant support member, the surface heat generating layer, the elastic layer, and the surface release layer are formed in order on the conductive shaft, the layers are in close adhesion and the shape of the heating roller can be maintained even when repetitively subjected to heating and cooling.

In the induction heating device of an example embodiment, when the surface heat generating layer formed between the conductive shaft and the surface release layer is a layered structure in which a plurality of elastic layers and heat generating layers are formed alternately, the releasability of the heating roller becomes excellent. That is, by providing a plurality of heat generating layers between the elastic layers with each heat generating layer being made thinner instead of forming the surface heat generating layer with one layer, it is possible to maintain the flexibility of the heat generating layer, and therefore the releasability of the heating roller is excellent.

In the induction heating device of an example embodiment, when heating the medium to be heated, a control means may be provided that heats the heating roller using an alternating magnetic field of a first frequency when the heating roller is to be set at a preset temperature and heats the heating roller using an alternating magnetic field of a second frequency (a higher frequency than the first frequency) when carrying out heat treatment of the medium to be heated. Employing this configuration enables the following effects to be achieved.

First, by providing the two heat generating layers, namely the conductive shaft and the surface heat generating layer, in the heating roller, and setting the thickness of the surface heat generating layer to not greater than the surface layer depth, the conductive shaft of the roller center is also heated, and therefore the non-conductive heat resistant support member that is installed between these heat generating layers can also store heat with good efficiency, but depending on the operational mode there are times when it is desirable to store heat in the non-conductive heat resistant support member and times when it is undesirable.

For example, when returning to normal from warming up or preheating, if the temperature of the non-conductive heat resistant support member is low (if the amount of stored heat is insufficient) even when the surface temperature of the heating roller has returned to normal, there are times when the surface temperature of the heating roller will drop during copying operations and cause fixing nonconformities. In order to prevent this, it becomes necessary to intensively heat the heat generating layer (conductive shaft) at the center of the heating roller and make heat be transferred and thermally stored in the non-conductive heat resistant support member with good efficiency. On the other hand, if the temperature of the non-conductive heat resistant support member is sufficiently high, it is unnecessary to intensively heat the heat generating layer at the center of the heating roller during copying operations and heat can be more efficiently transferred to the toner and the paper by heating focusing on the surface heat generating layer.

Accordingly, in an example embodiment, the heat generation ratio between the conductive shaft and the surface heat generating layer can be controlled by changing the drive frequency in response to the operational mode. For example, by setting the drive frequency high, the penetration depth (surface layer depth) of the alternating magnetic fields linked in the heat generating layer becomes smaller, and therefore the alternating magnetic fields do not link in the conductive shaft of the roller center and the amount of heat produced is reduced. Conversely, when it is desired to intensively heat the conductive shaft at the center of the roller, the drive frequency is lowered. By doing this, the surface layer depth becomes deeper and therefore the amount of heat produced increases.

By changing the induction heating conditions in response to the operational mode as described above, it is possible to change the heat generation ratios of the surface heat generating layer and the heating layer (conductive shaft) present at the center of the roller, and therefore it is possible to carry out optimal thermal storage to the non-conductive heat resistant support member.

An induction heating device of an example embodiment is provided with a heating roller having a conductive heat generating layer and a magnetic field producing means arranged on a external periphery of the heating roller, and configured such that the conductive heat generating layer is heated by applying alternating magnetic fields, produced by the magnetic field producing means, in the conductive heat generating layer of the heating roller, and heat of the heating roller is transferred to a medium to be heated at open portions where the magnetic field producing means is not arranged at the periphery of the heating roller, wherein an auxiliary heat source is provided inside the heating roller and a heat source control means is provided for controlling output of the magnetic field producing means and the auxiliary heat source according to a condition by which the heating roller is set to a preset temperature and a condition by which heat treatment of the medium to be heated is carried out when heating the medium to be heated.

With the induction heating device of an example embodiment, since an auxiliary heat source is provided inside the heating roller, it is possible to raise the temperature of the conductive shaft and transfer heat to the non-conductive heat resistant support member in a very short time. Thus, thermal storage to the non-conductive heat resistant support member can be completed in a very short time and it is possible to very efficiently prevent drops in the surface temperature during continuous copying in a short time.

Moreover, since induction heating systems are localized heating systems in which the amount of heat produced is greater in the heat generating layer positioned close to the heating coil, temperature unevenness is produced in the circumferential direction of the heating roller when preheating is carried out while the heating roller is in a stationary state. To overcome this temperature unevenness in the circumferential direction, temperature adjustment is required over a long time, thereby presenting the problem that it is difficult to reduce the time of the first copy, but by using the auxiliary heat source inside the heating roller during preheating, it is possible to prevent temperature unevenness in the circumferential direction, which makes it possible to further reduce the time of the first copy and improves convenience.

In the induction heating device of an example embodiment, the heat source control means may be configured to carry out control such that the output of the auxiliary heat source is set smaller than the output of the magnetic field producing means when heating the medium to be heated. A reason for carrying out such control is described below.

First, during the passing of paper in an image forming apparatus or the like, the heat at the surface of the heating roller is rapidly taken into the paper, and therefore it is necessary to rapidly heat the roller surface. To achieve this, it is possible to carry out stable temperature control free of temperature drops during the passing of paper by carrying out heating with an outside heat source.

On the other hand, when a copying operation starts in a state in which the inside of the heating roller has a lower temperature than the surface of the roller, the heat supplied from the outside heat source is transferred to both the surface and the inside of the heating roller, and the temperature drops with respect to the roller surface, and therefore the temperature of the roller surface is prevented from dropping by increasing the temperature of the inside of the heating roller using an auxiliary heat source, which is an inside heat source. However, when there is strong heating using the inside heat source (auxiliary heat source), the temperature of the conductive shaft rises and the interface temperature between the conductive shaft and the non-conductive heat resistant support member rises, thus causing peeling. To prevent this, as described above, the heat source control means carries out electric power control such that the output of the auxiliary heat source is set smaller than the output of the magnetic field producing means when heating the medium to be heated.

In an example embodiment, an image forming apparatus may be configured using an induction heating device having an above-described characteristic as a fixing device. In this case, since heating is carried out using the conductive shaft in addition to the surface heat generating layer of the heating roller, it is possible to prevent surface temperature drops of the heating roller that occur during continuous copying and to consistently carry out continuous copying operations without pauses in processing or reductions in processing speed, as well as being possible to control the heat generation ratios of the surface heat generating layer and the conductive shaft in response to the operational mode, and therefore an image forming apparatus can be provided in which fixing can be carried out with excellent efficiency.

BRIEF DESCRIPTION OF THE DRAWINGS

FIG. 8*b* is a graph showing surface temperature conditions of the heating roller during continuous copying when using a working example 5.

DESCRIPTION OF EXAMPLE EMBODIMENTS

Hereinafter, example embodiments will be described with reference to the accompanying drawings.

Figure 1:
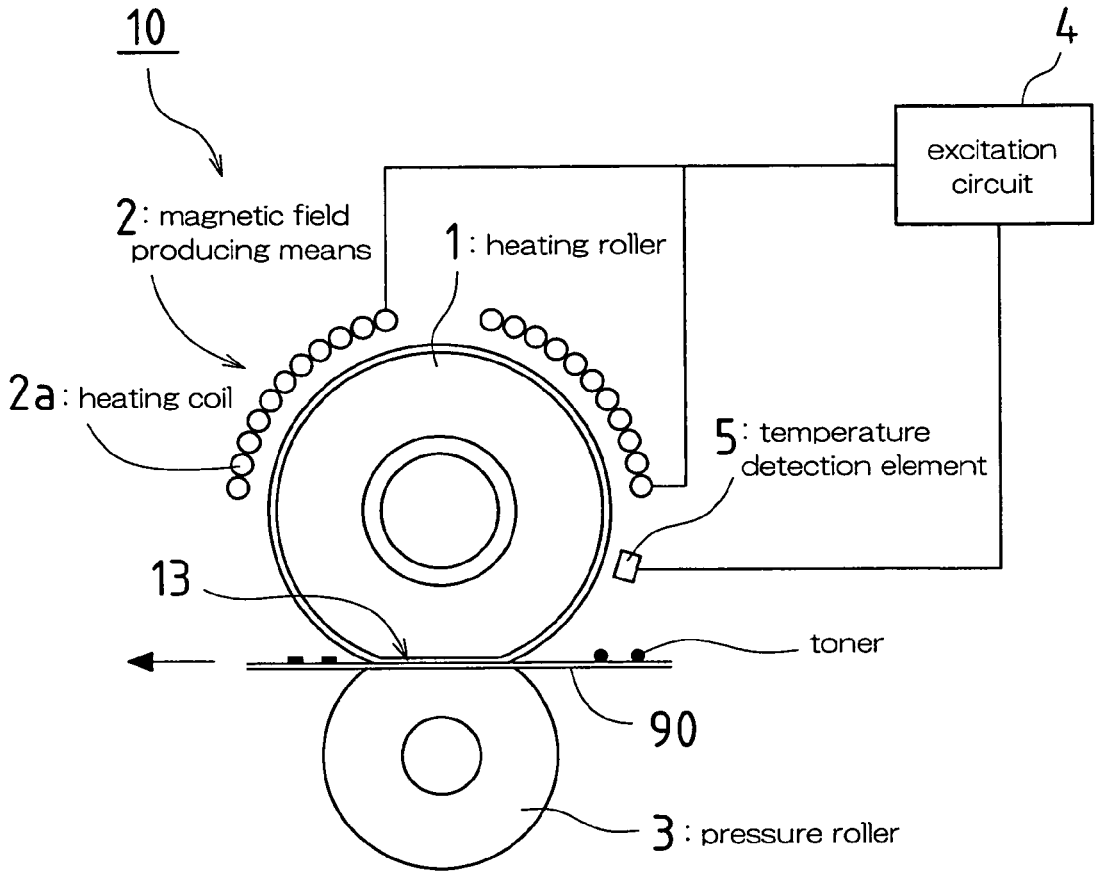
FIG. 1 schematically shows one example of an induction heating device according to an example embodiment.

First, one example of an induction heating device according to the present invention will be described with reference to FIG. 1.

An induction heating device 10 of this example is configured by components such as a heating roller 1 having a conductive heat generating layer, a magnetic field producing means 2 (heating coil 2*a*) arranged outside this layer, a temperature detection element (a thermistor for example) 5 that detects the temperature of the heating roller 1, an excitation circuit 4 that drives the magnetic field producing means 2 according to the temperature detection of the temperature detection element 5, and a pressure roller 3, which abuts the heating roller 1, for sandwiching and carrying a recording sheet (medium to be heated) 90. The heating roller 1 is heat controlled so that the detected temperature of the temperature detection element 5 becomes a predetermined temperature, and is configured such that the recording sheet 90, which has unfixed toner, is subjected to melt fastening (fixing) by heat and pressure on the recording sheet 90 being passed through a fixing nip portion 13 formed by a contact area between the heating roller 1 and the pressure roller 3.

Next, structural elements constituting various portions of the induction heating device 10 are described.

First, a detailed description of an example of the heating roller 1 is given below by here describing a general structure of a heating roller that can be used for induction heating.

It is necessary for at least one layer of a heat generating layer (conductive heat generating layer) constituted by a conductive material to be present on the heating roller 1 in order to achieve induction heating. A material having magnetic properties is suitable for the conductive material and iron or a stainless steel material such as SUS 430 can be used. In particular, higher relative permeability is better, and materials such as a silicon steel plate, a magnetic steel plate, and nickel steel may be used. Furthermore, even with a non-magnetic material, induction heating can be achieved as long as it is a material that has a high resistance value such as a stainless steel material such as SUS 304, and therefore this may be used. Moreover, it is possible to use a non-magnetic base material (a ceramic or a resin for example) as long as this is structured such that an above-described material having a high relative permeability is arranged so as to provide conductivity. Furthermore, the conductive heat generating layer may be constituted by a composite material made from a plurality of materials in order to increase the amount of heat generated. Concerning the structure and materials of a conductive shaft material and a surface release layer, it is possible to use the same components as used in ordinary halogen lamp systems.

The pressure roller 3 contacts the heating roller 1 and is a member for forming the fixing nip portion 13 through which the recording sheet 90 passes.

The pressure roller 3 is constituted having a heat-resistant elastic layer (not shown in drawing) such as silicone rubber on a core of iron, stainless steel, or aluminum. The pressure roller 3 is pressed against the heating roller 1 by an unshown elastic member (spring) such that the fixing nip portion 13 of a width of approximately 5 to 6 mm is formed between the pressure roller 3 and the heating roller 1. It should be noted that a surface release layer made of PFA (a copolymer of tetrafluoroethylene and perfluoroalkyl vinyl ether) or PTFE (polytetrafluoroethylene) may be formed on the surface of the pressure roller 3. A pressure roller 3 of this example has an outer diameter of 40.0 mm and a surface hardness (Asker C hardness) of 80°.

Figure 2:
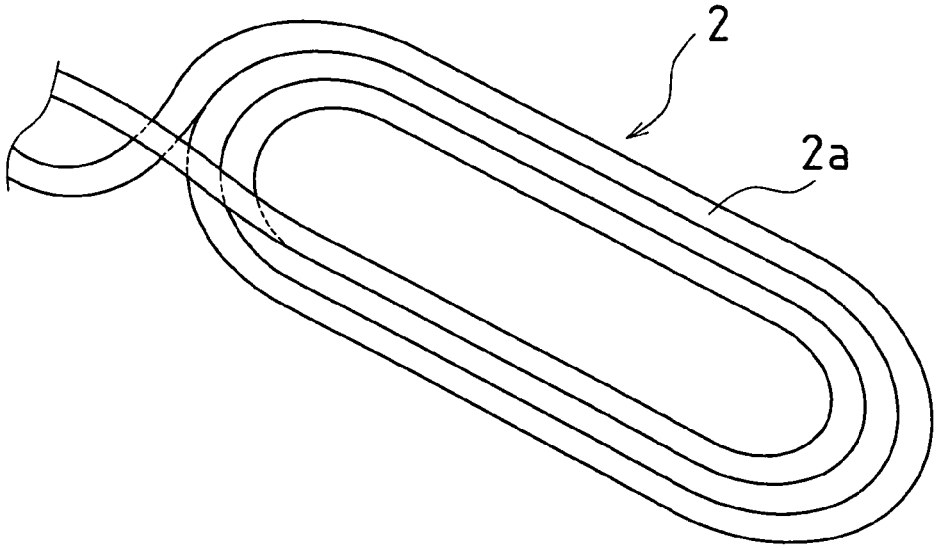
FIG. 2 is a perspective view showing a structure of a heating coil of a magnetic field producing means used in the induction heating device of FIG. 1.

As shown in FIG. 2, the magnetic field producing means (induction heating means) 2 that heats the heating roller 1 is constituted by a heating coil 2*a* configured so as to cluster around the outer perimeter of the heating roller 1. When the heating coil 2*a* is arranged at the outer perimeter of the heating roller 1 in this way, even if the heating coil 2*a* receives radiation heat from the heating roller 1, heat release occurs at the surface on the opposite side, and therefore the temperature of the heating coil 2*a* is lower than when arranged on the inner side of the heating roller 1. Thus, it becomes possible to use low cost wire rod with a low heat resistance grade. Furthermore, when the heating coil 2*a* rises in temperature, the resistance of the wire rod increases and the amount of heat produced (copper loss) by the heating coil 2*a* itself increases such that the heating efficiency is reduced, but this too becomes able to be prevented.

A heat resistant material is used in the wire rod that constitutes the heating coil 2*a*. In the example here, a Litz wire (a stranded wire of enamel wires or the like) in which fifty insulated 0.23 mm diameter wires are entwined is used. To inhibit copper loss occurring in the heating coil 2*a*, the total resistance value of the heating coil 2*a* should be not greater than 0.5 Ω and preferably not greater than 0.1 Ω. It should be noted that a plurality of heating coils 2*a* may be arranged corresponding to the size of the recording sheet 90 to be fixed. In the example here, a single coil with a winding number of 13 is used.

Figure 3:
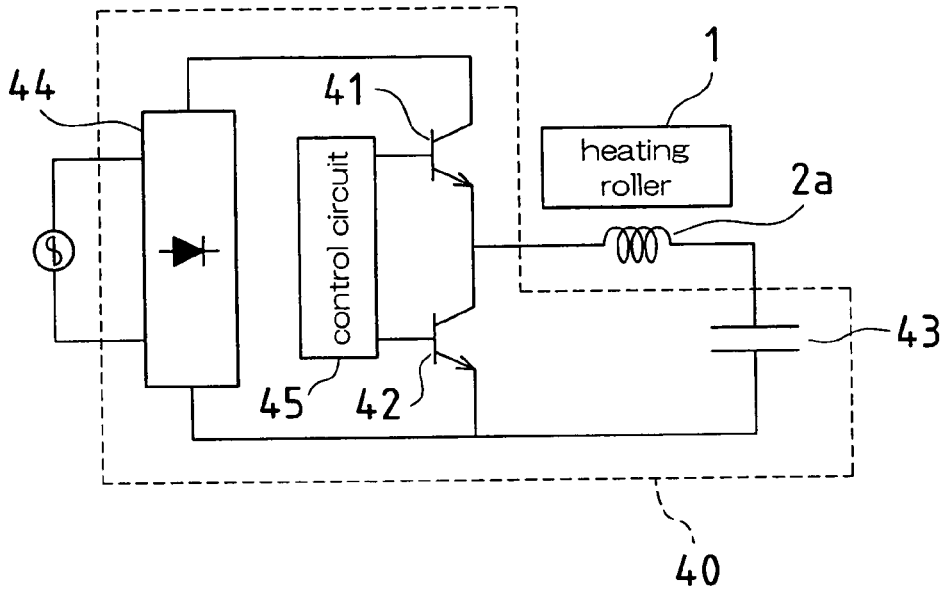
FIG. 3 shows a circuit structure of a coil electric current producing portion of an excitation circuit used in the induction heating device of FIG. 1.

Next, the excitation circuit 4 that runs a high-frequency current through the heating coil is described with reference to FIG. 3. It should be noted that the circuit in FIG. 3 is one type of a power supply circuit called a half-bridge type SEPP system.

The excitation circuit 4 is provided with a coil electric current producing portion 40 that is constituted by two switching elements 41 and 42, a resonant capacitor 43, a rectifier circuit 44, a control circuit 45 and the like. The heating coil 2*a* is connected to the resonant capacitor 43.

Of the two switching elements 41 and 42, the switching element 41 on the one hand is serially connected to the heating coil 2*a* and the resonant capacitor 43, while on the other hand, the switching element 42 is connected in parallel to the heating coil 2*a* and the resonant capacitor 43. By having the control circuit 45 alternately turn on and off these switching elements 41 and 42 matched to a timing of a predetermined frequency, it is possible to apply a predetermined high-frequency current to the heating coil 2*a* based on a resonance phenomenon of the heating coil 2*a* and the resonant capacitor 43.

A heating operation is described next.

First, when warming up, the switching element 41 and the switching element 42 (FIG. 3) of the excitation circuit 4 connected to the heating coil 2*a* are repetitively turned on and off at a predetermined frequency such that a high-frequency alternating current is applied to the heating coil 2*a*. This produces high-frequency alternating magnetic fields in the heating coil 2*a* and an eddy current is created by applying these alternating magnetic fields in the conductive layer of the heating roller 1 such that the heating roller 1 produces Joule heat. The amount of heat produced at this time is approximately 900 W. Moreover, at the same time as flow of electricity from the power supply device commences, the pressure roller 3 is driven to rotate by the driving rotation of the heating roller 1. The surface temperature of the heating roller 1 is constantly detected by the temperature detection element (a thermistor for example) 5, and warming up is completed when the surface temperature of the heating roller 1 reaches a predetermined temperature (170° C. in this example), and the driving frequency of the excitation circuit 4 to the heating coil 2*a* is switched. This adjusts the electric power so that the surface temperature of the heating roller 1 can be maintained at the predetermined temperature.

Next, the recording sheet (medium to be heated) 90 on which an unfixed toner image has been transferred is carried to the fixing nip portion 13 between the heating roller 1 and the pressure roller 3, and the toner image is subjected to melt fixing by the heat of the heating roller 1 and the pressure of the pressure roller 3 such that a durable image is fixed onto the recording sheet 90.

The following is a description of a specific example of an induction heating device according to the present invention.

WORKING EXAMPLE 1

Figure 4:
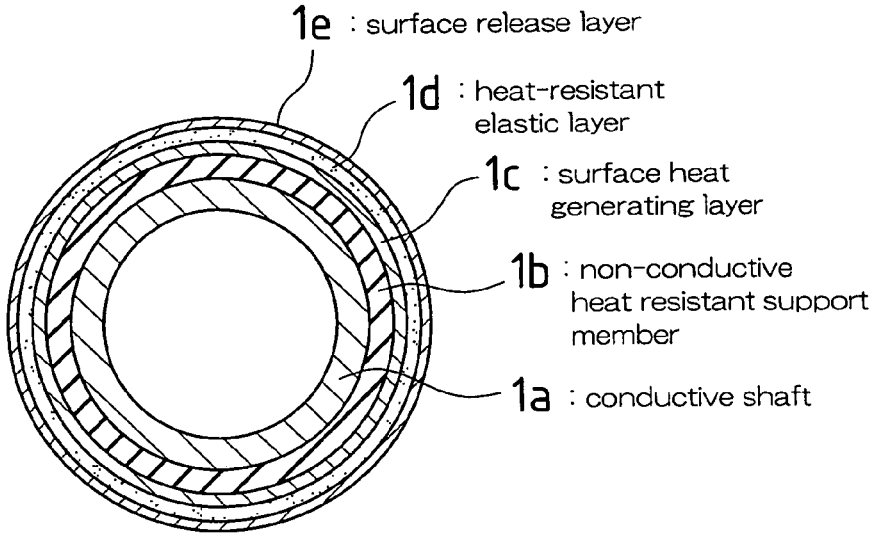
FIG. 4 is a view showing a cross sectional structure of a heating roller.

FIG. 4 is a cross sectional view showing a specific structure of the heating roller 1. The heating roller 1 of this example has a characteristic point in that a non-conductive heat resistant support member 1*b*, a surface heat generating layer 1*c*, a heat-resistant elastic layer 1*d*, and a surface release layer 1*e* are layered in order on a conductive shaft 1*a*. The specifications of each of these layers and the purpose and effect of installing these layers are described below.

First, the surface release layer 1*e* formed on the outermost surface of the heating roller 1 has a role of preventing toner, which has been heated at the fixing nip portion 13 (FIG. 1) and whose viscosity has been lowered, from adhering to the heating roller 1. Materials that can be used include Teflon (registered trademark) based materials having high releasability, for example PFA (a copolymer of tetrafluoroethylene and perfluoroalkyl vinyl ether) or PTFE (polytetrafluoroethylene) or the like. In the example here, PFA of a 30 μm thickness is used.

The heat-resistant elastic layer 1*d* formed under the surface release layer 1*e* is provided to improve the adhesiveness between the melted toner and the surface release layer 1*e*. Materials that can be used for the heat-resistant elastic layer 1*d* include heat-resistant silicon rubber (LTV, RTV, and HTV) or the like. In the example here, heat-resistant silicone rubber (LTV) is used in the heat-resistant elastic layer 1*d*.

Also, in this example, two heat generating layers are provided as conductive heat generating layers heated by induction heating, namely the surface heat generating layer 1*c* arranged directly under the non-conductive heat resistant support member 1*b*, and the conductive shaft 1*a* arranged through the surface heat generating layer 1*c* and the non-conductive heat resistant support member 1*b* in order to reduce the temperature-raising time and prevent drops in the surface temperature of the heating roller during continuous copying.

From the point of view of shortening the temperature-raising time, it is preferable that the surface heat generating layer 1*c* is made thin so as to have a low thermal capacity. However, when the thermal capacity here is made too low, the amount of heat thermally stored in the surface heat generating layer 1*c* is small, and therefore the roller temperature drops when performing continuous copying, which results in the issue of fixing nonconformities being produced.

Accordingly, an example embodiment is configured such that when the surface heat generating layer 1*c* is made thin, alternating magnetic fields produced by the magnetic field producing means 2 pass through the surface heat generating layer 1*c*, and a phenomenon (skin effect) is used in which the alternating magnetic fields reach until the very center portion of the heating roller 1 with the conductive shaft 1*a* provided as a second heat generating layer on the underside of the surface heat generating layer 1*c*, so that the non-conductive heat resistant support member 1*b* is heated and accumulates heat using the heating of the conductive shaft 1*a*, which is also subjected to induction heating, and the surface heat generating layer 1*c*. By using this configuration, the non-conductive heat resistant support member 1*b* is subjected to heating from two directions, and therefore the temperature difference that is present between the surface heat generating layer 1*c* and the non-conductive heat resistant support member 1*b* becomes smaller. That is, the thermal loss from the surface heat generating layer 1*c* to the non-conductive heat resistant support member 1*b* becomes smaller, and the surface temperature of the heating roller 1 does not drop even when continuous copying is carried out.

Optimal thickness of the surface heat generating layer and distance between the installation of the two heat generating layers are present in order to use the above-mentioned phenomenon and cause the non-conductive heat resistant support member to accumulate heat efficiently. This point is described below.

First, a relationship is shown below in Table 1 in which the heat generation ratio between the surface heat generating layer and the conductive shaft changes due to the thickness of the surface heat generating layer.

TABLE 1

| | Thickness of surface heat generating layer | | |
|---|---|---|---|
| | 30 μm | 40 μm | 80 μm |
| Surface heat generating layer | 92.7% | 94.5% | 95.2% |
| Conductive shaft | 7.3% | 5.5% | 4.8% |

As evident from Table 1, the heat generation ratio of the conductive shaft changes for thinner thicknesses of the surface heat generating layer. This is caused by a phenomenon in which the alternating magnetic fields concentrate in the surface layer area of conductive materials when alternating magnetic fields are linked in a conductive material. This phenomenon is called the skin effect and in particular the thickness of the areas in which the alternating magnetic fields concentrate in the surface layer area of conductive materials is referred to as surface layer depth.

Surface layer depth δ is expressed by a formula [$\delta=\sqrt{(2/(\sigma 1\cdot\mu 1\cdot\mu 0\cdot 2\pi f))}$ . . . (1)], and varies depending on the materials used and the drive frequency. Note here that σ1 represents the electric conductivity of the heat generating members, μ1 represents the relative permeability of the heat generating members, μ0 represents electric conductivity in a vacuum, and f represents the drive frequency.

The values shown in table 1 are for a case when nickel is used in the surface heat generating layer, the drive frequency is 40 kHz, and the distance between the surface heat generating layer and the conductive shaft is 6 mm. To achieve induction heating with nickel, a high frequency of 20 kHz or more is necessary, and the surface layer depth δ should be not greater than 100 μm.

Also, as evident in table 1, it is clear that even if the thickness of the surface heat generating layer is not greater than the surface layer depth, the heat generation ratio of the conductive shaft increases for thinner thicknesses of the surface heat generating layer, and that when the thickness of the surface heat generating layer approaches the surface layer depth, the heat generation ratio of the conductive shaft decreases, and the heat resistant support member cannot be heated. To describe this using the values shown in table 1, when the thickness of the surface heat generating layer is 80 μm, the heat generation ratio of the conductive shaft is only approximately 5% of the total electric power, and in contrast to this, when this is 30 μm, the heat generation ratio increases to 7%. From the point of view of heating the conductive shaft, it is preferable for the surface heat generating layer to be thinner.

Next, a relationship between the placement distance between the surface heat generating layer and the conductive shaft and the heat generation ratios of both heat generating layers is shown in table 2.

TABLE 2

| | Distance between surface heat generating layer and conductive shaft | | |
|---|---|---|---|
| | 1.5 mm | 4 mm | 6 mm |
| Surface heat generating layer | 75.2% | 92.3% | 94.5% |
| Conductive shaft | 24.8% | 7.7% | 5.5% |

As is evident from table 2, the amount of heat produced by the conductive shaft increases for closer distances between the surface heat generating layer and the conductive shaft, that is, it increases for thinner thicknesses of the non-conductive heat resistant support member.

Figure 5:
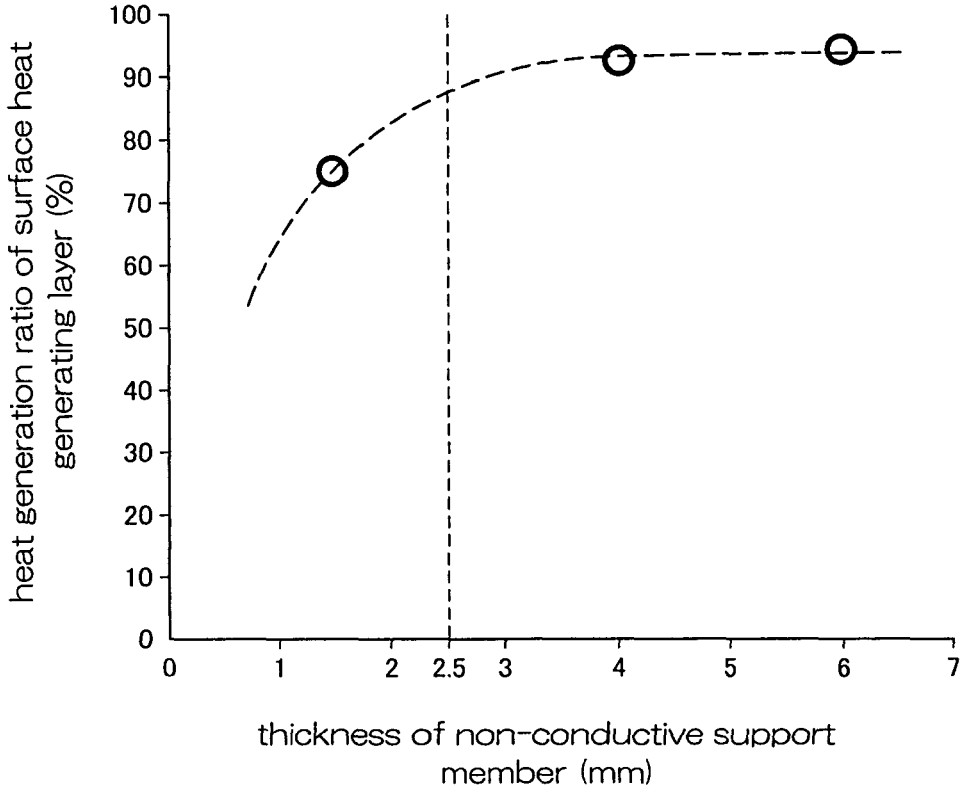
FIG. 5 is a graph showing a relationship between thickness of a non-conductive support member and a heat generation ratio of a surface heat generating layer.

For example, the heat generation ratio of the conductive shaft when the thickness of the non-conductive heat resistant support member is 4 mm is approximately 8% of the total electric power, but this increases to 25% when this thickness becomes 1.5 mm. In terms of thoroughly heating the conductive shaft, it is better for the non-conductive support member to be thin, but there is no need to thoroughly heat the conductive shaft during a continuous copying operation, and the heat generation ratio of the surface heat generating layer becomes important. For example, FIG. 5 shows the results of table 2 graphically, and it is evident from FIG. 5 that it is preferable for the thickness of the non-conductive heat resistant support member to be 2.5 mm or more since the heat generation ratio of the surface heat generating layer becomes 80% or more. It should be noted that when the non-conductive heat resistant support member becomes too thick, the above-described heating effect cannot be anticipated since the conductive shaft cannot produce heat.

Also, it is preferable that the non-conductive heat resistant support member used in an example embodiment, that is, the heat resistant layer held sandwiched by the two conductive heat generating layers is constructed by a low thermal capacity material in order to shorten the warming time. For example, materials that have lower specific heat and specific gravity than metals may be used, such as engineering plastics including polyimide, PPS (polyphenylene sulfide), and PAI (polyamide-imide), silicon rubber that is a heat resistant rubber material, fluorocarbon rubber, or ceramics or the like.

From the point of view of the above, in the present example, nickel of a 40 μm thickness is used in the surface heat generating layer 1*c*, and a solid type silicone rubber of a 4 mm thickness is used in the non-conductive heat resistant support member 1*b*, while aluminum of a 3 mm thickness is used in the conductive shaft 1*a*. Moreover, a heat-resistant elastic layer 1*d* made of silicone rubber of a thickness of 400 μm is formed on the surface heat generating layer 1*c*, and on top of this is formed a surface release layer 1*e* constituted by Teflon (registered trademark) made of PFA of a thickness of 30 μm.

WORKING EXAMPLE 2

In working example 2, there is a special feature in the material by which the surface heat generating layer is constructed. A point of difference from the above-described working example 1 is that in contrast to the thin metal used in the surface heat generating layer in working example 1, a material is used in which conductive filler is dispersed in a resin material or a rubber material. It should be noted that examples of the conductive filler include metals such as nickel, iron, aluminum, and silver, and conductive materials such as carbon for example.

Using a material having the above-described structure in the surface heat generating layer improves the extensibility or the flexibility of the heat generating layer. This lessens inhibition of deformation of the heat-resistant elastic layer formed underneath the surface release layer, and therefore the adhesiveness between melted toner and the surface release layer can be improved. Furthermore, this lessens inhibition of flexure of the heat-resistant elastic layer, and therefore auto-release can be achieved at the exit of the fixing nip without providing an assistive means such as release claws. This effect can be further enhanced by using an elastic solid to construct the non-conductive heat resistant support member that is held sandwiched by the two heat generating layers. This is because when the non-conductive heat resistant support member is formed by an elastic solid, a total of three elastic layers are formed, that is, the non-conductive heat resistant support member (elastic layer), the elastic heat generating layer, and the heat-resistant elastic layer on top of these layers, and therefore the surface of the heating roller becomes very flexible.

Here, the results of evaluating a relationship between the structural materials of the surface heat generating layer and the self releasability are shown in table 3 below. As evident from table 3, it is clear that the self releasability is better when the surface heat generating layer is formed as a composite material such as a resin than when formed as a single metal material. It should be noted that the results of table 3 are evaluation results for when the non-conductive heat resistant support member is a silicone rubber.

TABLE 3

| | Material of surface heat generating layer | | |
|---|---|---|---|
| | Nickel | PI | Rubber |
| Self releasability | Δ | ○ | ◎ |

◎ Consistent and excellent self releasability for all sheets
○ Excellent self releasability for all sheets
Δ Inconsistent self releasability for thin sheets

WORKING EXAMPLE 3

Another example of the heating roller 1 is described. Similar to the above-described working example 1, the heating roller 1 of this example too is formed having a non-conductive heat resistant support member 1*b*, a surface heat generating layer 1*c*, a heat-resistant elastic layer 1*d*, and a surface release layer 1*e* layered in order on a conductive shaft 1*a* (see FIG. 4). These layers and the conductive shaft are described in detail below.

First, a hollow aluminum cylinder with an outer diameter of 31.32 mm is used as the conductive shaft 1*a* in this example.

It should be noted that the materials and form of the conductive shaft 1*a* are not limited to this and for example a material able to maintain hardness and with good thermal conduction including metals such as iron may be used. Furthermore, more specifically concerning hardness, since there is a large pressing force to maintain the wide nip width by pressing together the heating roller 1 and the pressure roller 3 (980 N (100 kgf) or more), the heating roller 1 requires a strength such that it will not yield under such a pressing force. Furthermore, when inserting a halogen lamp as a heat source inside the conductive shaft 1*a*, the form of the conductive shaft should be hollow.

Next, the non-conductive heat resistant support member 1*b* is formed on the conductive shaft 1*a*.

Since it is necessary for the non-conductive heat resistant support member (elastic layer) 1*b* to efficiently transfer the heat produced inside the conductive shaft 1*a* to the surface layer, it is preferable that a member having low thermal resistance is used as the material. Moreover, since it is possible to achieve release without a releasing means particularly for unfixed color images by producing flexure in the nip portion formed when the heating roller 1 and the pressure roller 3 are pressed together, and making it wide, and further still, by using a convex form for the shape of the nip formed by the pressing together of the heating roller and the pressure roller, it is preferable that these are provided as members having great flexibility.

Examples of materials that can be used for the non-conductive heat resistant support member 1*b* include silicone rubber, fluorocarbon rubber, and fluorosilicone rubber. Of these, it is preferable to use silicone rubber, which has particularly excellent rubber elasticity.

It is preferable that the thickness of the non-conductive heat resistant support member 1*b* is not less than 1 mm and not greater than 6 mm. When the thickness of the non-conductive heat resistant support member 1*b* is less than 1 mm, a sufficient nip width cannot be achieved and it is unable to fulfill a role as an elastic layer. Furthermore, when the thickness exceeds 6 mm, the thermal resistance from the inside heating source until the surface of the heating roller 1 becomes large. As a result, the temperature difference increases between the internal temperature of the conductive shaft 1*a* and the surface temperature of the heating roller 1 such that it is necessary to raise the temperature of the conductive shaft 1*a* in order to maintain the surface of the heating roller 1 at the predetermined temperature, and the temperature at the adhesive interface between the conductive shaft 1*a* and the non-conductive heat resistant support member 1*b* becomes a temperature unable to withstand the heat resistance of the non-conductive heat resistant support member 1*b*. To fulfill these conditions, in this example, silicone rubber of a material hardness of 5° is used and the non-conductive heat resistant support member 1*b* is formed with a uniform thickness on the conductive shaft 1*a* with a thickness of 4 mm.

Next, the surface heat generating layer 1*c* is formed on the non-conductive heat resistant support member 1*b*.

It is necessary for the surface heat generating layer 1*c* to have at least one layer constituted by a conductive material in order to achieve induction heating. Generally iron or a stainless steel material such as SUS 430 is used as the conductive material, but in this example, by having the surface heat generating layer 1*c* present between the non-conductive heat resistant support member (elastic layer) 1*b* and the heat-resistant elastic layer 1*d*, the surface heat generating layer 1*c* is formed having metal particles (Ag) dispersed in silicone rubber base material with a material hardness of 20° in order to not lose elasticity between the non-conductive heat resistant support member 1*b* and the heat-resistant elastic layer 1*d*. Here, in order to improve the adhesiveness between the surface heat generating layer 1*c* and the non-conductive heat resistant support member 1*b*, t is preferable that the silicone rubber member used is a member with substantially the same coefficient of linear expansion.

By using silicone rubber in this way as the base material used for the elastic layers and the heat generating layers, it is possible to vary the rubber hardness.

Specifically, it is necessary that the base material for forming the heat generating layer (surface heat generating layer 1*c*) is bonded strongly to the elastic layer non-conductive heat resistant support member 1*b* (or the heat-resistant elastic layer 1*d*) to prevent bond separation or the like. As described above, it is preferable here that a low material hardness rubber (a rubber hardness of 5° for example) is used for the non-conductive heat resistant support member 1*b* from the point of view of nip width and releasability, but although low material hardness rubbers have excellent flexibility, their adhesive strength is weakened when metal particles are dispersed in the rubber material such that separation is prone to occur at the interface between the surface heat generating layer 1*c* and the non-conductive heat resistant support member 1*b*.

Accordingly, a silicone rubber with a high material hardness (a rubber hardness of 20° for example) is used with the aim of increasing the adhesiveness of the silicone rubber used in the surface heat generating layer 1*c*. It should be noted that although the material hardness of the silicone rubbers in the base material of the non-conductive heat resistant support member 1*b* and the base material of the surface heat generating layer 1*c* are different, their coefficient of linear expansion is substantially the same.

The coefficient of linear expansion is described next. The coefficient of linear expansion is a coefficient that expresses the extent of expansion (extension) when there is a temperature change from a given temperature T1 to T2.

The coefficient of linear expansion of the silicone rubber having a material hardness of 5° used in this example is $25\times10^{-5}$/° C. and the result of measuring the coefficient of linear expansion of silicone rubber with rubber hardness in the range of 1° to 20° was 20 to $40\times10^{-5}$/° C. If the material is in this range, the members will have substantially the same coefficient of linear expansion.

Furthermore, it is necessary that the thickness of the surface heat generating layer 1*c* is thin enough to be able to maintain the flexibility of the non-conductive heat resistant support member 1*b* and the heat-resistant elastic layer 1*d*, and it is preferable that this is thinned to a thickness not less than 1 μm and not greater than 30 μm. When the thickness is less than 1 μm, a portion of the surface heat generating layer 1*c* becomes discontinuous and unable to produce heat. On the other hand, when the thickness is greater than 30 μm, the flexibility of the non-conductive heat resistant support member 1*b* is lost and the self releasability is reduced.

Figure 12:
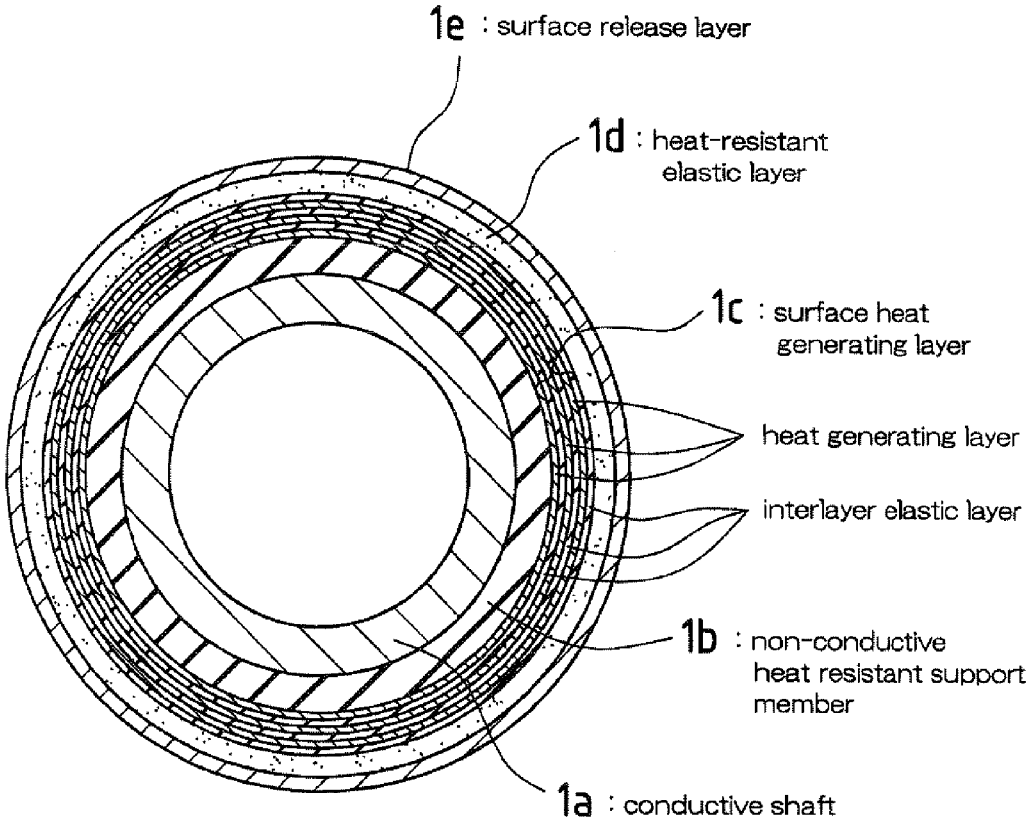
FIG. 12 schematically shows one example embodiment of the disclosed technology.

Further still, as demonstrated in FIG. 12, in order to maintain the flexibility of the non-conductive heat resistant support member 1*b*, it is possible to provide a plurality of heat generating layers that constitute the surface heat generating layer 1*c* while reducing the thickness of each of these heat generating layers, as well as providing separate elastic layers (interlayer elastic layers) between each of the plurality of heat generating layers, thereby enabling the amount of heat produced to be increased while maintaining flexibility by increasing the thickness of the heat generating layer to increase the amount of heat produced while maintaining flexibility. It should be noted that in this example, heat generating layers of a thickness of 10 μm and interlayer elastic layers of a thickness of 10 μm are alternately layered in repetition to form the surface heat generating layer 1*c* constituted by a total of six layers, namely three heat generating layers and three interlayer elastic layers.

Next, the heat-resistant elastic layer 1*d* is formed on the surface heat generating layer 1*c*.

The heat-resistant elastic layer 1*d* is for uniformly transferring the heat from the heating roller 1 when the surface release layer 1*e* deforms according to the bumpiness of the surface of the recording sheet when the recording sheet (medium to be heated) is pressed against the heating roller 1 by the pressure roller 3.

Here, when fixing an unfixed color image, it is necessary to perform fixing on up to four layers of toner that have been overlapped, and depending on the location on the recording sheet, there are places in which there is a toner layer and places in which there is no toner layer, and therefore the surface of the recording sheet is bumpy. Furthermore, since the recording sheet itself has bumpiness depending on the paper grade, it is necessary to have a structure in which the surface of the surface release layer 1*e* flexibly encompasses the toner in order to comply with these bumpinesses and fix the unfixed color image, and for this reason it is necessary to provide an elastic layer (heat-resistant elastic layer 1*d*) between the surface release layer 1*e* and the surface heat generating layer 1*c*. In this example, a silicone rubber having a thickness of 250 μm and a rubber hardness of 5 degrees (JIS-A) is used as the material for the heat-resistant elastic layer 1*d*, but there is no limitation to this.

It is preferable that a same material (substantially the same coefficient of linear expansion) as the non-conductive heat resistant support member 1*b* is used as the material of the heat-resistant elastic layer 1*d*, but any material having rubber elasticity and excellent heat resistance may be used such as silicone rubber, fluorocarbon rubber, and fluorosilicone rubber. Of these, it is preferable to use silicone rubber, which has particularly excellent rubber elasticity.

It is preferable that the thickness of the heat-resistant elastic layer 1*d* is not less than 50 μm and not greater than 400 μm. When the thickness of the heat-resistant elastic layer 1*d* is greater than 400 μm, the thermal capacity of the heating roller itself becomes large, and therefore the warm up time is made longer and the energy for achieving heating is increased. When the thickness of the heat-resistant elastic layer 1*d* is less than 50 μm, it becomes unable to comply to the bumpiness of the toner on the recording sheet surface, and therefore uniform melting on the surface cannot be achieved and uneven gloss is produced.

Next, the surface release layer 1*e* is formed on the heat-resistant elastic layer 1*d*.

Materials that can be used for the surface release layer 1*e* include materials having excellent heat resistance and durability, as well as poor adhesion with toner, including for example PFA (a copolymer of tetrafluoroethylene and perfluoroalkyl vinyl ether) and PTFE (polytetrafluoroethylene) or other fluorocarbon based materials. In the example here, a PFA tube of a thickness of approximately 30 μm is used.

A heating roller thus constructed has a surface hardness of 55° (ASCA-C hardness) and an outer diameter of 40.0 mm.

As described above, in working example 3, the non-conductive heat resistant support member 1*b*, the surface heat generating layer 1*c*, heat-resistant elastic layer 1*d*, and the surface release layer 1*e* are formed in order on the conductive shaft 1*a*, and therefore the layers are in close adhesion and are able to maintain the shape of the heating roller 1 even when repetitively subjected to heating and cooling.

Next, heating and cooling experiments were carried out on the heating roller manufactured in working example 3 and a heating roller manufactured in Comparative Example 1 shown below using a method described later.

COMPARATIVE EXAMPLE 1

A heating roller was manufactured in which the base material of the surface heat generating layer and the base material of the non-conductive heat resistant support member are materials having different coefficients of linear expansion. Specifically, the silicone rubber used in the above-described examples was used as the non-conductive heat resistant support member, and polyimide (PI; coefficient of linear expansion=$4\times10^{-5}$/° C.) was used as the base material of the surface heat generating layer. Layers the same as those described in working example 3 were used for the other layers.

[Heating and Cooling Experiment]

(S1) Heating roller heated from room temperature to 130° C.

(S2) Heating roller temperature maintained at 130° C. for 10 minutes (S3) Heating roller cooled from 130° C. to room temperature As shown in table 4 below, the result of carrying out the above-described heating and cooling experiment was that in comparative example 1, wrinkling occurred in the axial direction of the heating roller when, the heating roller was cooled from 130° C. to room temperature, and repetitively carrying out heating and cooling after this did not improve the wrinkling. In contrast to this, no particular wrinkling occurred in the heating roller in working example 3. This is because substantially the same extension and contraction occurs in the heating and cooling cycles of the heating roller.

COMPARATIVE EXAMPLE 2

A heating roller was manufactured by forming as separate members a component (elastic roller) in which a non-conductive heat resistant support member was formed on a conductive shaft, and a component (cylindrical heat generating member) in which a heat-resistant elastic layer and a surface release layer were formed on a heat generating layer, then coating the outer periphery of the above-mentioned elastic roller with an adhesive in a later process for insertion to the above-mentioned cylindrical heat generating member.

The heating and cooling experiment described earlier was carried out on the heating roller manufactured in comparative example 2. As shown in table 4 below, a result was that in comparative example 2, "raising" occurred on portions of the surface of the heating roller, and this "raising" became larger during repetitions of heating and cooling. This is thought to be because slight gaps are produced between the outer diameter of the elastic roller and the inner diameter of the heat generating layer when inserting the cylindrical heat generating member, and "raising" is produced from adhesion non-conformities due to this gaps.

TABLE 4

| | Roller form |
|---|---|
| Comparative Example 1 | X |
| Comparative Example 2 | X |
| Working Example 3 | ○ |

○: No change in form such as wrinkling in roller or raising
X: Wrinkling or raising produced in roller during heating and cooling stages

WORKING EXAMPLE 4

A special feature of working example 4 is that in a heating control technique of induction heating, the drive frequency is changed in response to the operational mode for changing the heat generation ratio of the two heat generating layers of the heating roller, namely, the conductive shaft and the surface heat generating layer. Other structural aspects are the same structure as described in the working examples up to here. For example, in describing the heating roller, other than using a component in the surface heat generating layer in which conductive filler is dispersed in a resin material, the structure is same as working example 1.

Table 5 below describes how the heat generation ratios of the two heat generating layers changes when the drive frequency changes, and how the amount of heat produced by the conductive shaft increases when the drive frequency is low. This phenomenon also has a relationship with the skin effect. Basically, this is a phenomenon originating in that the surface layer depth δ expressed in the above-described relational expression (1) is a function of the drive frequency. An example embodiment achieves control of the heat generation ratios of the conductive shaft and the surface heat generating layer by using this phenomenon.

TABLE 5

| | Drive frequency | |
|---|---|---|
| | 30 kHz | 60 kHz |
| Surface heat generating layer | 89.2% | 95.0% |
| Conductive shaft | 10.8% | 5.0% |

Figure 6:
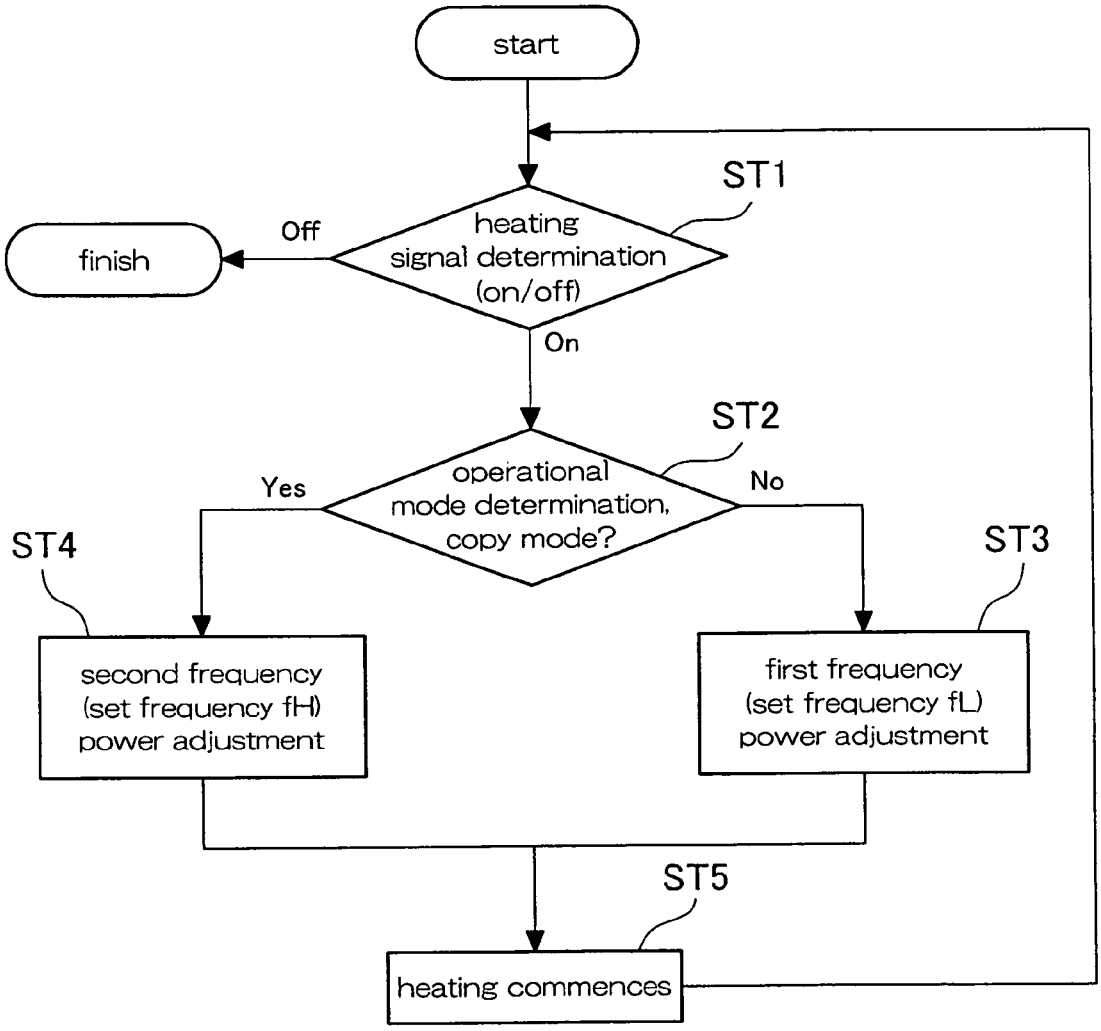
FIG. 6 is a flowchart showing an operation when a drive frequency is varied in the induction heating device of an example embodiment.

Next, a specific control technique is described with reference to the flowchart shown in FIG. 6.

First, a determination is made as to whether a heating signal is "on" or "off" (step ST 1), and when the heating signal is "on," a determination is made (step ST 2) as to whether or not the set operational mode is "copy mode." When the set operational mode is not "copy mode" (for example during warm up or during preheating), the drive frequency is set to a low value fL (a first frequency at approximately 39 kHz for example), and heating commences (step ST 3 and ST 5) once electric power adjustments have been made. On the other hand, when the set operational mode is "copy mode," the drive frequency is set to a high value fH (a second frequency at approximately 45 kHz for example), and heating commences (step ST 4 and ST 5) once electric power adjustments have been made.

Thus, by executing control such that heating is carried out with the drive frequency set low in conditions when it is desirable for the non-conductive heat resistant support member 1*b* to accumulate heat such as during warm up or preheating, and carrying out heating with the drive frequency set high to intensively heat the surface heat generating layer 1*c* during copying operations, it is possible to change the heat generation ratios between the surface heat generating layer 1*c* and the conductive shaft 1*a* present inside the roller, and therefore it is possible to achieve optimal thermal storage to the non-conductive heat resistant support member 1*b*, and it is possible to efficiently prevent temperature drops in the heating roller 1 that occur during continuous copying.

Figure 7:
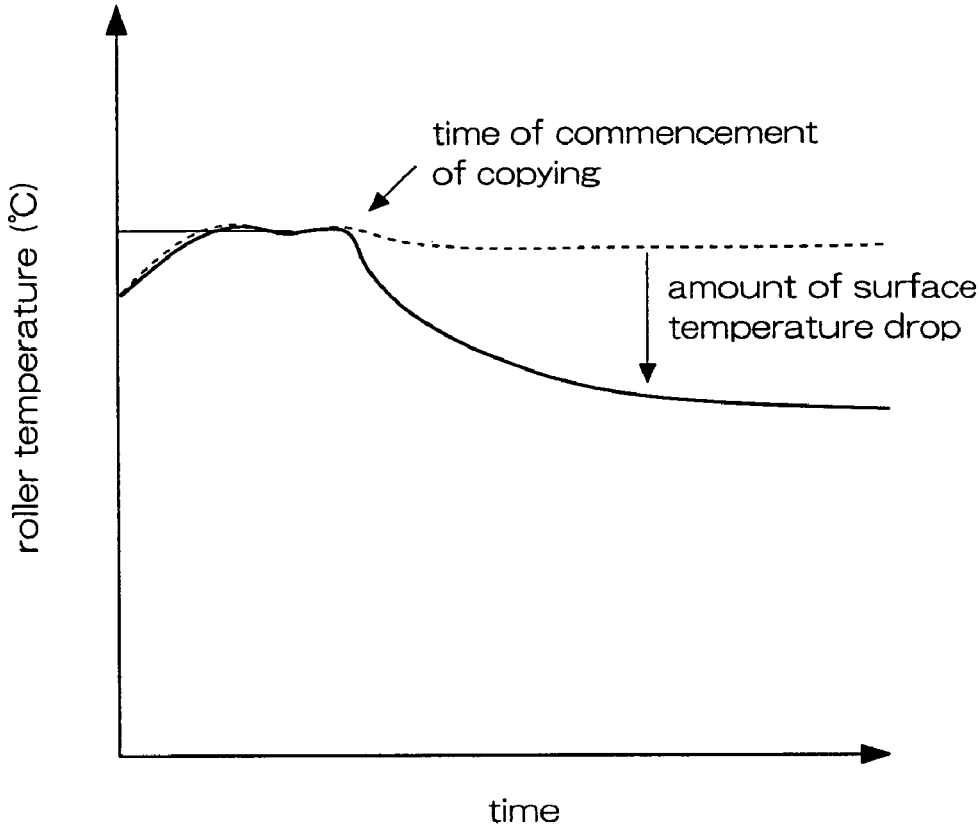
FIG. 7 is a graph showing temperature change of the heating roller when continuous printing is carried out immediately after warm up.

Here, a condition in which the temperature of the heating roller drops immediately after commencement of continuous copying when the above-described drive frequency control has not been applied is shown in FIG. 7. Although drops in the temperature of the heating roller also depend on the conditions, these drops are usually approximately 20° C. immediately after commencement of paper passing. The paper transport speed is 117 mm/s and the supply speed of recording sheets is 26 sheets every minute.

Figure 8A:
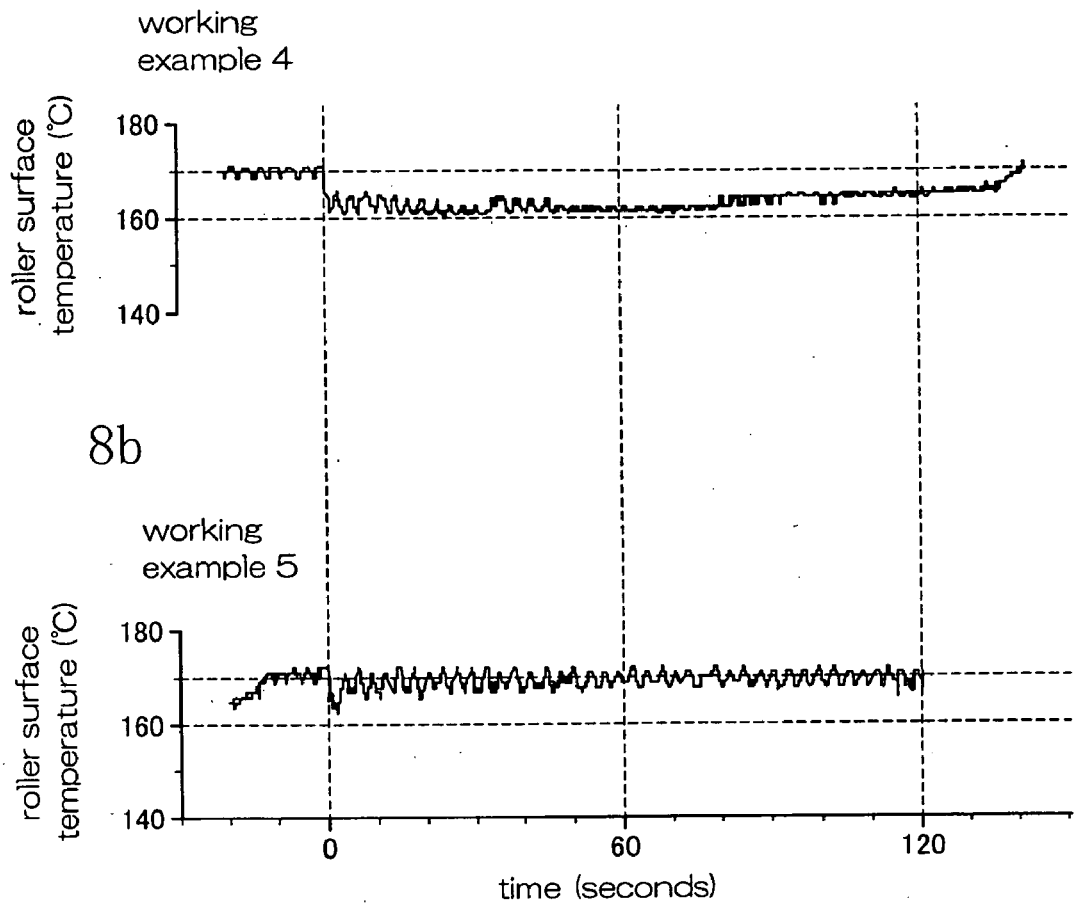
FIG. 8*a* is a graph showing surface temperature conditions of the heating roller during continuous copying when using a working example 4.

In contrast to this, test results of when control of drive frequency has been actually carried out are shown in FIG. 8*a*. As evident from the results in FIG. 8*a*, although a temperature drop of approximately 10° C. is evident immediately after commencement of continuous copying, it is apparent that by controlling the drive frequency it is possible to achieve consistent continuous copying without temperature drops after this. It should be noted that the results of FIG. 8*a* are test results in which the drive frequency was set to 39 kHz during warm up and 45 kHz during paper carrying, with the amount of heat produced being approximately 800 W during copying. It should also be noted that the paper transport speed and the supply speed of recording sheets was the same as described above.

WORKING EXAMPLE 5

Figure 9:
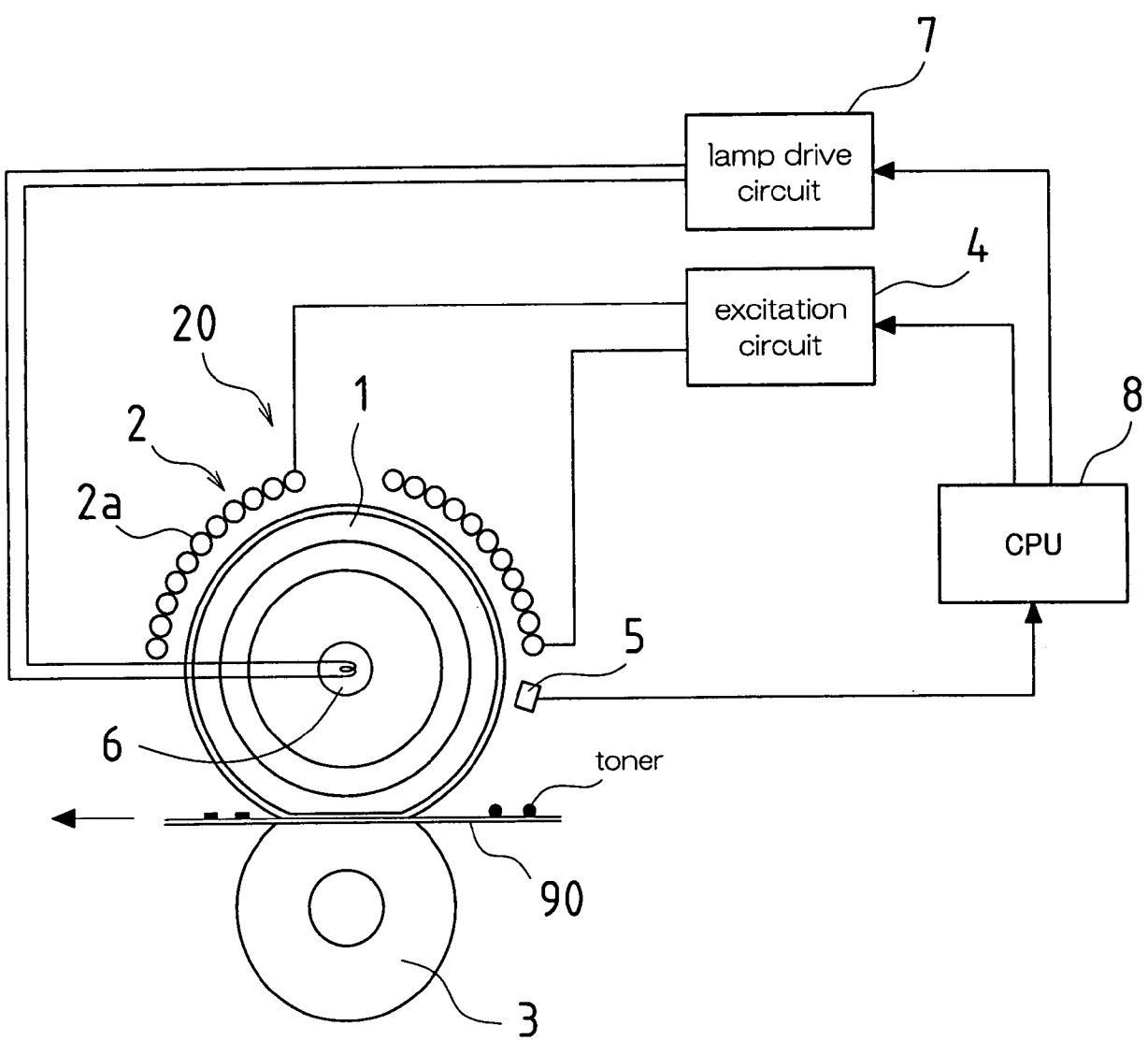
FIG. 9 schematically shows another example of an induction heating device according to an example embodiment.

FIG. 9 schematically shows a separate example structure of an induction heating device according to the present invention.

The induction heating device of this example has a special feature in that an auxiliary heat source (halogen lamp) 6 for assisting thermal storage to the non-conductive heat resistant support member 1*b* (see FIG. 4) is provided inside the heating roller 1.

A specific heating technique carried out in this example has a special feature in that power distribution and heating means are selected corresponding to the operational mode such that under conditions in which thermal storage to the non-conductive heat resistant support member 1*b* is necessary such as during warm up and during preheating, both internal heating by the auxiliary heat source 6 and induction heating by the magnetic field producing means 2, which is an outside heat source, are carried out, but only induction heating by the magnetic field producing means 2 is carried out during continuous copying.

Heating control here is carried out by a CPU (central processing unit) 8 respectively drive controlling the excitation circuit 4 of the magnetic field producing means 2 and a lamp drive circuit 7 of the auxiliary heat source (halogen lamp) 6 according to a temperature detected by the temperature detection member 5 or the like.

Results of measuring the surface temperature of the heating roller 1 when the above heating control is carried out are shown in FIG. 8*b*. As evident from FIG. 8*b*, the surface temperature of the roller does not drop even when continuous copying is carried out and a predetermined temperature can be maintained. To describe this with respect to actual heating conditions, the auxiliary heat source (halogen lamp) 6 and the magnetic field producing means 2, which is an outside heat source, are respectively given 450 W during warm up, and the heating coil 2*a* of the magnetic field producing means 2 is given 800 W during copying operations.

Then, even when carrying out continuous copying, continuous copying can be carried out consistently without drops in the surface temperature of the heating roller by controlling an induction heating device 20 as in working example 4.

For the paper carrying in the image forming apparatus here, it may be that only the outside heat source is operated as described above during copying operations, but heating may be carried out by both the magnetic field producing means 2, which is an outside heat source, as well as heating by the auxiliary heat source (halogen lamp) 6. This heating control is described below.

First, depending on structural conditions of the heating roller 1, for example conditions such as the surface heat generating layer 1*c* being thicker than the surface layer depth, the electric power supplied from the outside power source being used to heat only the surface heat generating layer 1*c*, and loss of heating to the conductive shaft 1*a* inside the roller, there are times when a copying operation commences in a state in which the inside of the heating roller 1 has a lower temperature than the roller surface. At this time, the heat that is applied from the outside heat source is transferred to both the surface of the heating roller 1 and inside the roller, and a temperature drop occurs with respect to the surface of the heating roller 1. When increasing the amount of power supplied to the auxiliary heat source (halogen lamp) 6 arranged inside the heating roller 1 to avoid this, there is a risk that the temperature rise of the conductive shaft 1*a* will deteriorate the durability of the non-conductive heat resistant support member 1*b*.

This point is described specifically below. First, a prediction was made using thermal analysis as to what temperature the conductive shaft of the heating roller 1 would reach when the proportion of power supplied (the heat generation ratio) to the inside heat source (auxiliary heat source 6) and the outside heat source (magnetic field producing means 2) was varied to continuously pass 500 sheets of recording paper at a speed of 70 sheets per minute in a state in which the fixing temperature was maintained at 170° C. (a state in which the surface temperature of the heating roller 1 was maintained at 170° C.). The results thereof are shown in table 6 below.

TABLE 6

| | Heat generation ratio | | | |
|---|---|---|---|---|
| Outside heat source | 0% | 50% | 70% | 100% |
| Inside heat source | 100% | 50% | 30% | 0% |
| Core temperature | 300% | 250% | 230% | 200% |

As is evident in table 6, when the power supplied to the inside heat source (auxiliary heat source 6) is larger than the power supplied to the outside heat source (magnetic field producing means 2), the temperature of the conductive shaft 1*a* rises to 250° C., thus exceeding the heat resistance temperature of the non-conductive heat resistant support member 1*b*, which is an elastic layer, and therefore it can be anticipated that nonconformities such as hardening or peeling of the non-conductive heat resistant support member 1*b* may occur. Consequently, it is necessary to set the power W1 of the inside heat source (auxiliary heat source 6) lower than the power W2 of the outside heat source (magnetic field producing means 2) (W2>W1). Also, since the temperature of the conductive shaft 1*a* rises due to the influence of the outside heat source (magnetic field producing means 2) if the conductive shaft 1*a* inside the roller is intensively heated by the outside heat source (magnetic field producing means 2), it is necessary in this case to further reduce the power supplied to the inside heat source (auxiliary heat source 6).

Example of an Image Forming Apparatus

Figure 10:
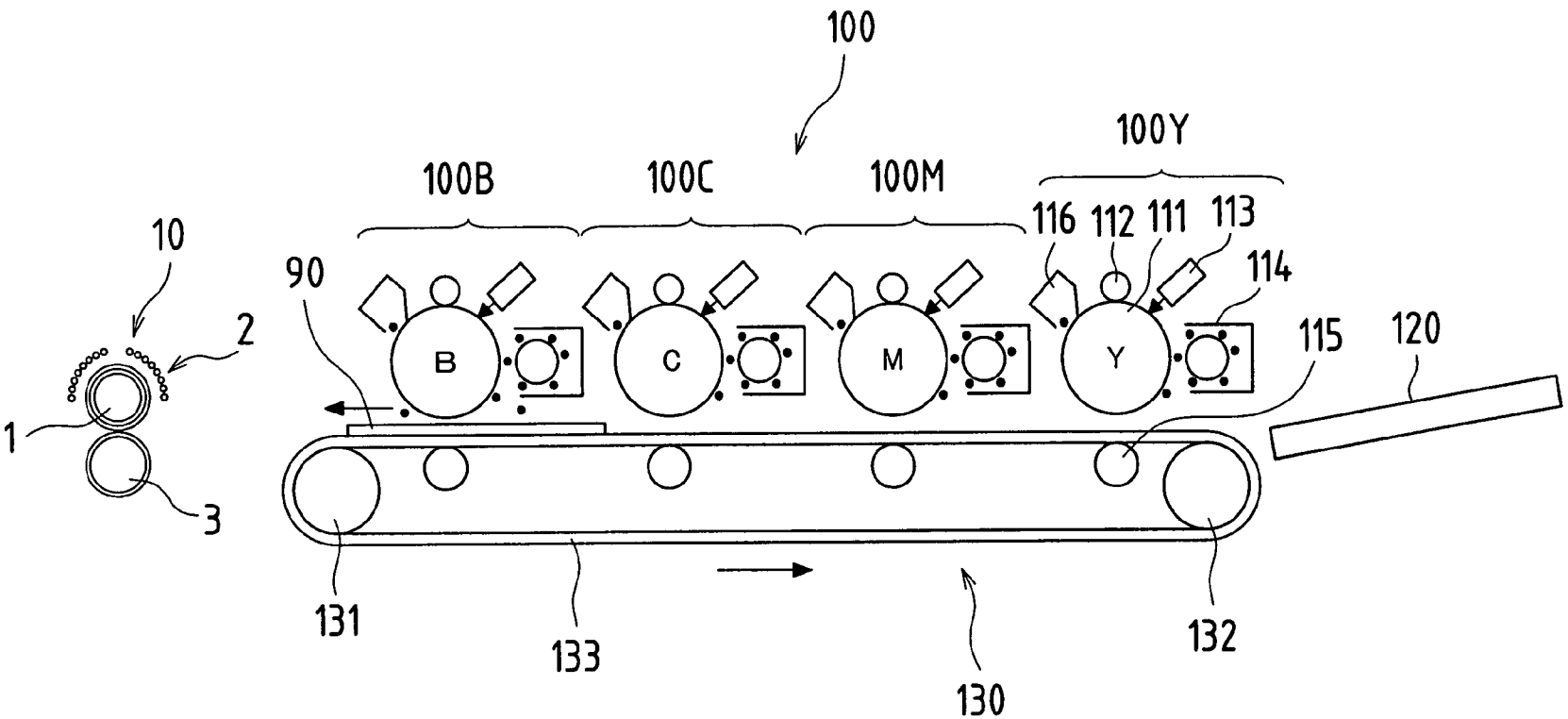
FIG. 10 schematically shows one example of an image forming apparatus according to an example embodiment.
Figure 11:
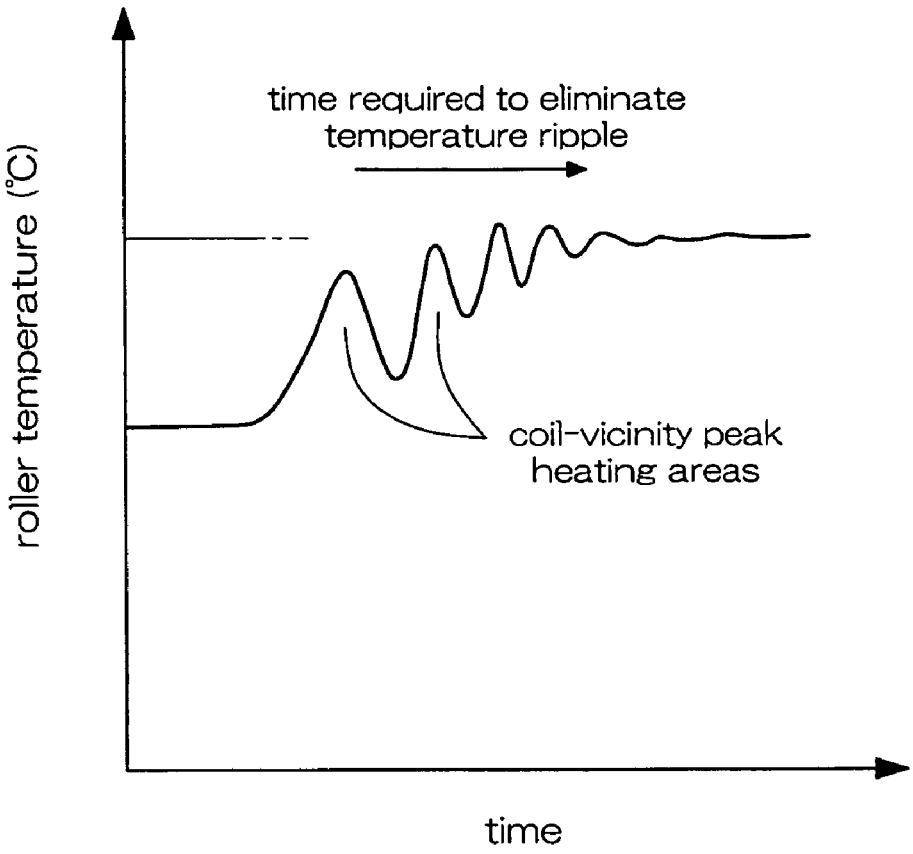
FIG.11 Prior Art
FIG. 11 is a graph showing temperature change of a prior art heating roller from a preheating state until a time of a return-to-normal operation.

FIG. 10 schematically shows one example of a color image forming apparatus to which the induction heating device of the present invention is applied.

A color image forming apparatus 100 of this example is a so-called tandem system printer in which visible image formation units of four colors 100Y, 100M, 100C, and 100B are arranged in a row along a carry path of a recording medium. Specifically, four visible image formation units 100Y, 100M, 100C, and 100B are arranged along the carry path of the recording sheet 90 connecting a supply tray 120 of the recording sheet 90 (medium to be heated) and an induction heating device 10 as the fixing device, and a full color image is formed by transferring the color toners in multiple layers to the recording sheet 90, which is carried by an endless belt recording sheet carrying means 130, and subsequently fixing these layers using the induction heating device (fixing device) 10, which is an example embodiment. It should be noted that the fixing device 10 has fundamentally the same structure as the example shown in FIG. 1.

Next, the structures of components of the color image forming apparatus 100 are described.

The recording sheet carrying means 130 is provided in a tensioned state using a pair of rollers, namely a drive roller 131 and an idling roller 132, and has an endless carrying belt 133 that is controlled to rotate at a predetermined peripheral speed (117 mm/s in this example), and the recording sheet 90 is electrostatically attached and carried on this carrying belt 133.

The visible image formation units 100Y, 100M, 100C, and 100B are respectively provided with photosensitive drums 111, and a charging roller 112, a laser irradiation means 113, a developing device 114, a transfer roller 115, and a cleaner 116 are arranged in order around the photosensitive drum 111.

Color toners of yellow (Y), magenta (M), cyan (C) and black (B) are contained in the developing devices 114 of the visible image formation units 100Y, 100M, 100C, and 100B. Each of the visible image formation units 100Y, 100M, 100C, and 100B then forms a toner image on the recording sheet 90 by the process described below.

After the surface of the photosensitive drum 111 is uniformly charged by the charging roller 112, an electrostatic latent image is formed on the surface of the photosensitive drum 111 by the laser irradiation means 113 using laser exposure corresponding to image information. After this, a toner image corresponding to the electrostatic latent image is formed on the photosensitive drum 111 by the developing device 114, and the toner images that have been made manifest are transferred in order onto the recording sheet 90, which is carried by the carrying means 130, by the transfer roller 115, which has been applied with a bias voltage with opposite polarity to that of the toner.

The recording sheet 90 on which the toner images have been transferred are released from the carrying belt 133 by the curvature of the drive roller 131 and is then carried to the fixing device 10. There it is applied with an appropriate temperature and pressure by the heating roller 1, which is maintained at a predetermined temperature, and the pressure roller 3. The toner is then melted and fixed to the recording sheet 90 to become a durable image. With the color image forming apparatus 100 of the example here, the surface temperature of the heating roller 1 of the induction heating device 10 can be kept from dropping even during continuous copying, and therefore it is possible carry out continuous copying operations consistently without temporary stoppages in processing or decreased processing speed.

It should be noted that the induction heating device of an example embodiment is not limited to the fixing device of the above-described color image forming apparatus and may be used as a heating device in such devices as a drying device in a wet process electrophotographic device, a drying device in an inkjet printer, and an erasing device for rewritable media.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An induction heating device comprising:

a heating roller having a plurality of conductive heat generating layers; and a magnetic field generator positioned adjacent an external periphery of the heating roller;

wherein the heating roller is configured such that the conductive heat generating layers are capable of generating heat as a result of application of alternating magnetic fields, produced by the magnetic field generator, to the conductive heat generating layers of the heating roller;

wherein one of said conductive heat generating layers of the heating roller comprises a conductive shaft that supports the heating roller, and another of said conductive heat generating layers comprises a surface heat generating layer;

a non-conductive heat resistant support member positioned between the conductive shaft and the surface heat generating layer;

wherein the heating roller is configured to promote heat generation by the conductive shaft;

wherein the heating roller is configured to promote heat accumulation in the non-conductive heat resistant support member;

wherein the heating roller is configured to accumulate in the non-conductive heat resistant support member heat generated by the conductive shaft and the surface heat generating layer;

wherein the heating roller comprises the non-conductive heat resistant support member, the surface heat generating layer, an elastic layer, and a surface release layer positioned about the conductive shaft, and the non-conductive heat resistant support member and the elastic layer comprise material having a coefficient of linear expansion within a predetermined range, and the surface heat generating layer comprises a composite material comprising, as a base material, a material of the non-conductive heat resistant support member or the elastic layer that is within the predetermined range of coefficient of linear expansion and a conductive material that has been dispersed within the base material;

wherein the surface heat generating layer positioned between the conductive shaft and the surface release layer has a structure in which a plurality of elastic layers and heat generating layers are formed alternately; and wherein the non-conductive heat resistant support member, the surface heat generating layer, the elastic layer, and the surface release layer are positioned in that order about the conductive shaft.

2. The induction heating device of claim 1, wherein said induction heating device is configured to transfer heat of the heating roller to a medium to be heated at open portions where the magnetic field generator is not adjacent an external periphery of the heating roller.

3. The induction heating device of claim 1, wherein the surface heat generating layer has a thickness sufficient to enable a portion of the alternating magnetic fields to pass through the surface heat generating layer.

4. The induction heating device of claim 1, wherein the surface heat generating layer comprises a composite material comprising a flexible material having a conductive material dispersed therein.

5. The induction heating device of claim 1, wherein the induction heating device is configured to heat said conductive shaft by virtue of skin effect.

6. The induction heating device of claim 1, wherein the surface heat generating layer has a surface layer depth; and wherein the thickness of the surface heat generating layer is not greater than a surface layer depth of the surface heat generating layer.

7. The induction heating device of claim 1, wherein the induction heating device is configured to prevent drops in a surface temperature of the heating roller that occur during continuous image forming.

8. The induction heating device of claim 1, whereby an image forming apparatus is capable of consistently carrying out continuous image forming without pauses in processing.

9. The induction heating device of claim 1, whereby an image forming apparatus is capable of consistently carrying out continuous image forming without reductions in processing speed.

* * * * *